US011557865B2

(12) United States Patent
Liu et al.

(10) Patent No.: US 11,557,865 B2
(45) Date of Patent: Jan. 17, 2023

(54) ELECTRICAL CONNECTOR HAVING AN OUTER CONDUCTOR AND A REAR METALLIC PLATE SECURED TO THE OUTER CONDUCTOR AND A TERMINAL WITH A PROTRUSION EXPOSED TO AIR AND SPACED A PREDETERMINED DISTANCE FROM THE REAR METALLIC PLATE

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Xiao-Tong Liu, Kunshan (CN); De-Jin Chen, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 26 days.

(21) Appl. No.: 17/189,168

(22) Filed: Mar. 1, 2021

(65) Prior Publication Data

US 2021/0273387 A1 Sep. 2, 2021

(30) Foreign Application Priority Data

Feb. 28, 2020 (CN) ..... 202010128198.7

(51) Int. Cl.

| | |
|---|---|
| ***H01R 24/54*** | (2011.01) |
| ***H01R 13/504*** | (2006.01) |
| ***H01R 103/00*** | (2006.01) |

(52) U.S. Cl.

CPC ..... *H01R 24/54* (2013.01); *H01R 13/504* (2013.01); *H01R 2103/00* (2013.01)

(58) Field of Classification Search

None

See application file for complete search history.

(56) References Cited

U.S. PATENT DOCUMENTS

| | | | | |
|---|---|---|---|---|
| 5,011,415 | A | 4/1991 | Suzuki et al. | |
| 5,088,937 | A | 2/1992 | Gabany | |
| 5,215,470 | A | 6/1993 | Henry et al. | |
| 6,116,914 | A * | 9/2000 | Koide | H01R 24/50 439/63 |
| 6,853,295 | B2 | 2/2005 | Takebe et al. | |
| 9,124,047 | B2 * | 9/2015 | Kanda | H01R 13/6474 |
| 9,812,823 | B2 | 11/2017 | Kawakami et al. | |
| 9,972,950 | B2 | 5/2018 | Kawakami et al. | |

(Continued)

FOREIGN PATENT DOCUMENTS

| | | |
|---|---|---|
| CN | 205069951 U | 3/2016 |
| CN | 106785614 A | 5/2017 |

*Primary Examiner* — Oscar C Jimenez

(74) *Attorney, Agent, or Firm* — Ming Chieh Chang

(57) ABSTRACT

An electrical connector includes: an insulator; a terminal secured in the insulator and having a front mating portion, a tail portion, and an intermediate portion; an outer conductor receiving the insulator; and a rear metallic plate secured to the outer conductor, wherein the terminal intermediate portion includes a vertical part having a protrusion exposing rearwardly to air and spaced a predetermined distance from the rear metallic plate.

10 Claims, 7 Drawing Sheets

(56) References Cited

U.S. PATENT DOCUMENTS

| | | | | |
|---|---|---|---|---|
| 10,700,461 | B2 | 6/2020 | Suzuki et al. | |
| 2008/0146087 | A1* | 6/2008 | Wu | H01R 24/50<br>439/733.1 |

* cited by examiner

ELECTRICAL CONNECTOR HAVING AN OUTER CONDUCTOR AND A REAR METALLIC PLATE SECURED TO THE OUTER CONDUCTOR AND A TERMINAL WITH A PROTRUSION EXPOSED TO AIR AND SPACED A PREDETERMINED DISTANCE FROM THE REAR METALLIC PLATE

BACKGROUND OF THE INVENTION

1. Field of the Invention

The present invention relates to an electrical connector comprising: an insulator; a terminal secured in the insulator and having a front mating portion, a tail portion, and an intermediate portion; an outer conductor receiving the insulator; and a rear metallic plate secured to the outer conductor, wherein the terminal intermediate portion has a protrusion that is spaced a predetermined distance from the rear metallic plate.

2. Description of Related Arts

China Patent No. 106785614 discloses an electrical connector comprising: an insulator, a terminal secured in the insulator and having a front mating portion, a tail portion, and an intermediate portion; an outer conductor receiving the insulator; and a rear metallic plate secured to the outer conductor.

SUMMARY OF THE INVENTION

An electrical connector comprises: an insulator; a terminal secured in the insulator and having a front mating portion, a tail portion, and an intermediate portion; an outer conductor receiving the insulator; and a rear metallic plate secured to the outer conductor, wherein the terminal intermediate portion includes a vertical part having a protrusion exposing rearwardly to air and spaced a predetermined distance from the rear metallic plate.

DETAILED DESCRIPTION OF THE PREFERRED EMBODIMENT

Figure 1:
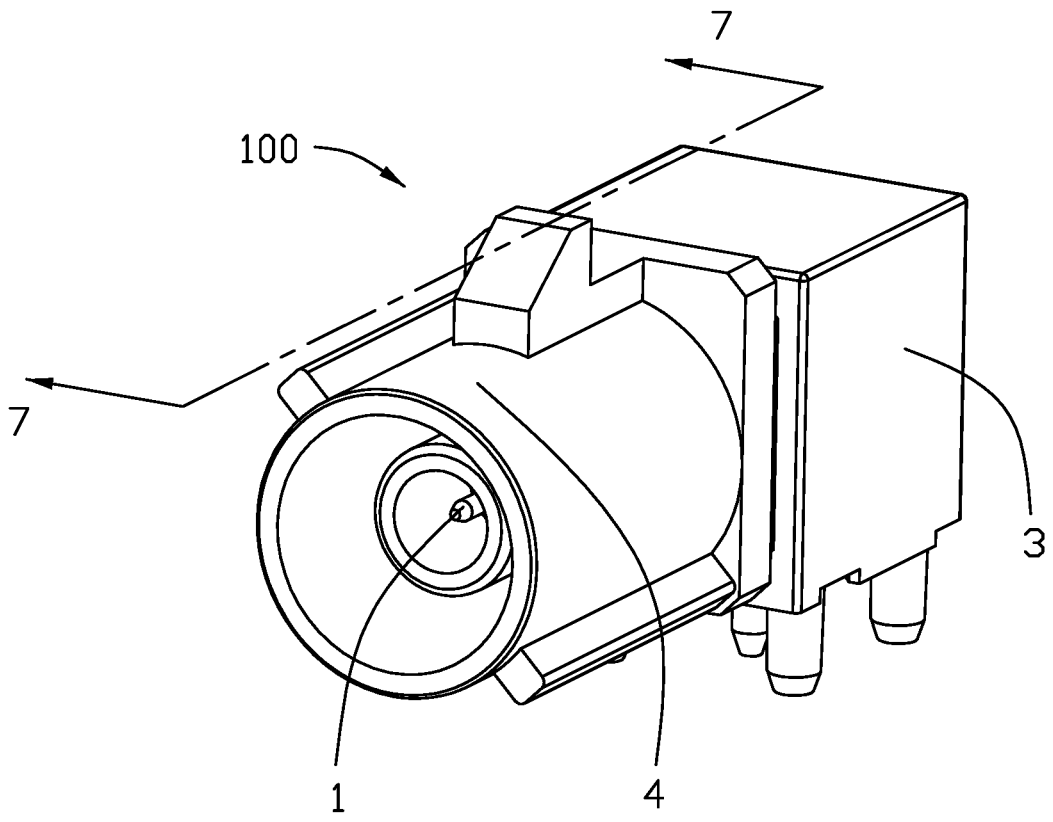
FIG. 1 is a perspective view of an electrical connector in accordance with the present invention.
Figure 2:
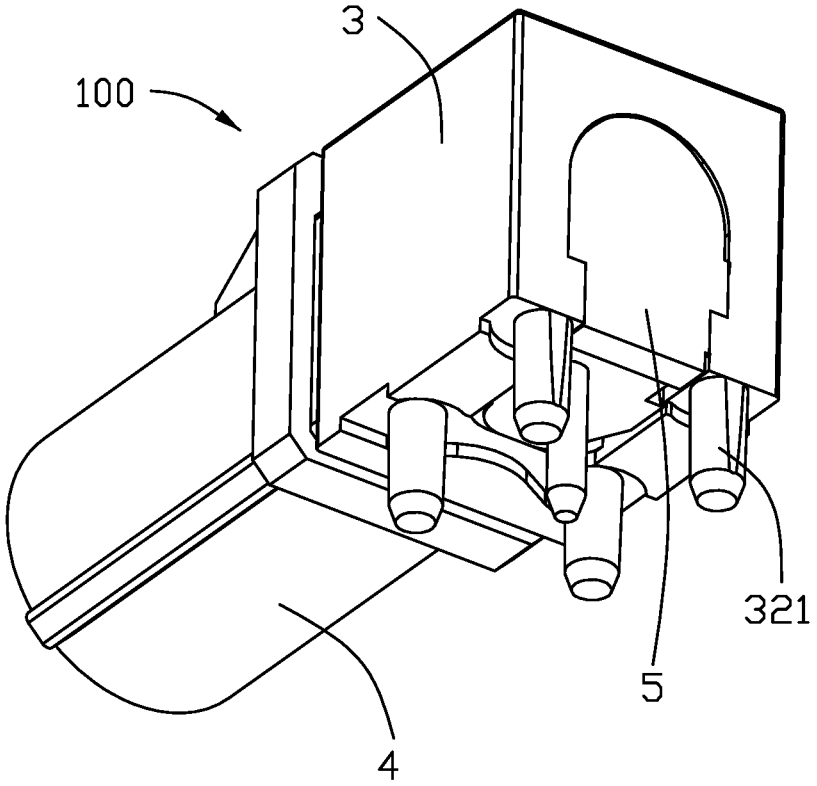
FIG. 2 is another perspective view of the electrical connector.

Referring to FIGS. 1-7, an electrical connector 100 comprises a terminal 1, an insulator 2 insert-molded with the terminal 1, an outer conductor 3 receiving the insulator 2, a rear metallic plate 5 secured to the outer conductor 3, and a latching housing 4.

Figure 5:
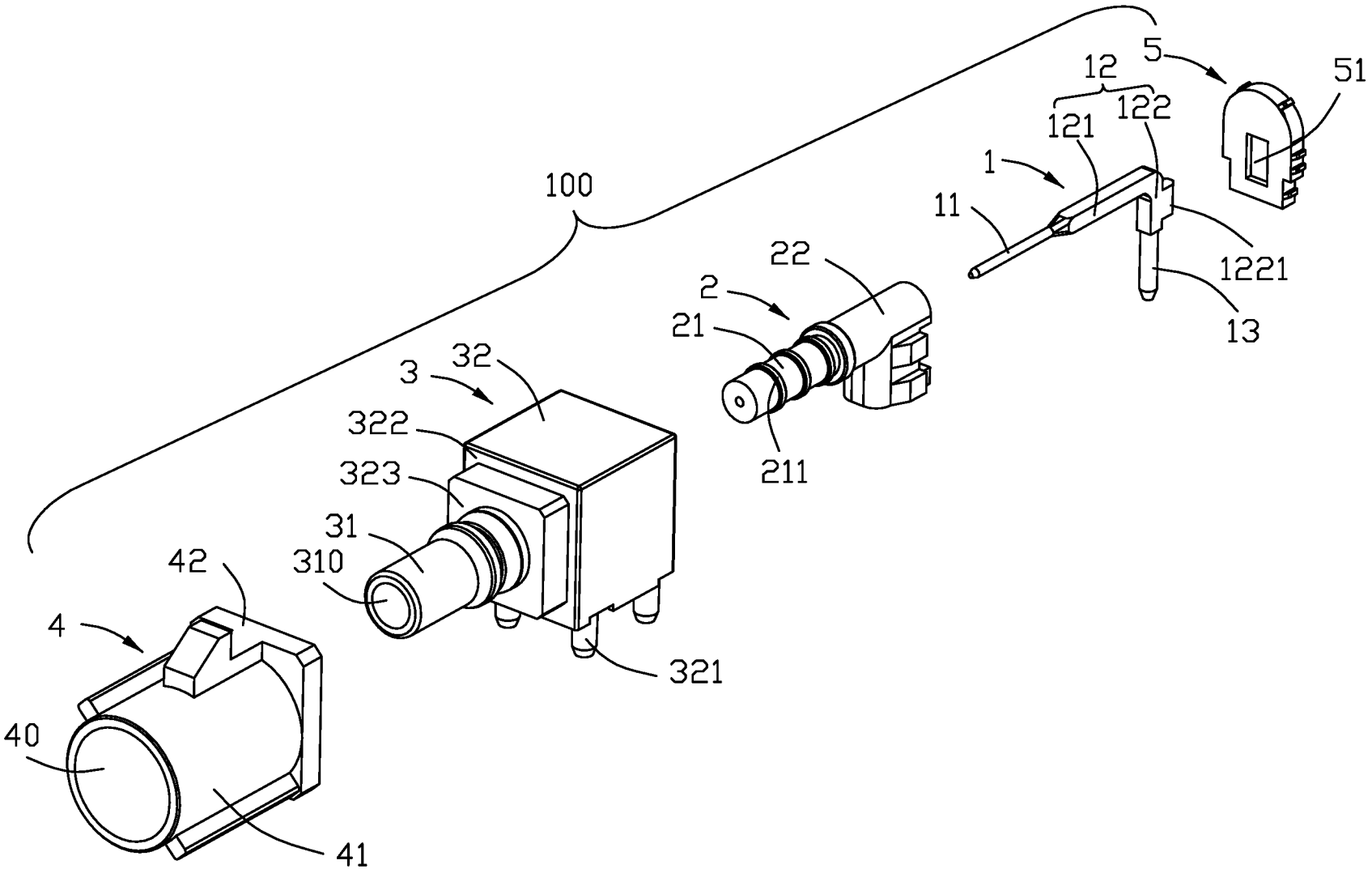
FIG. 5 is a further exploded view of the electrical connector in FIG. 3.
Figure 6:
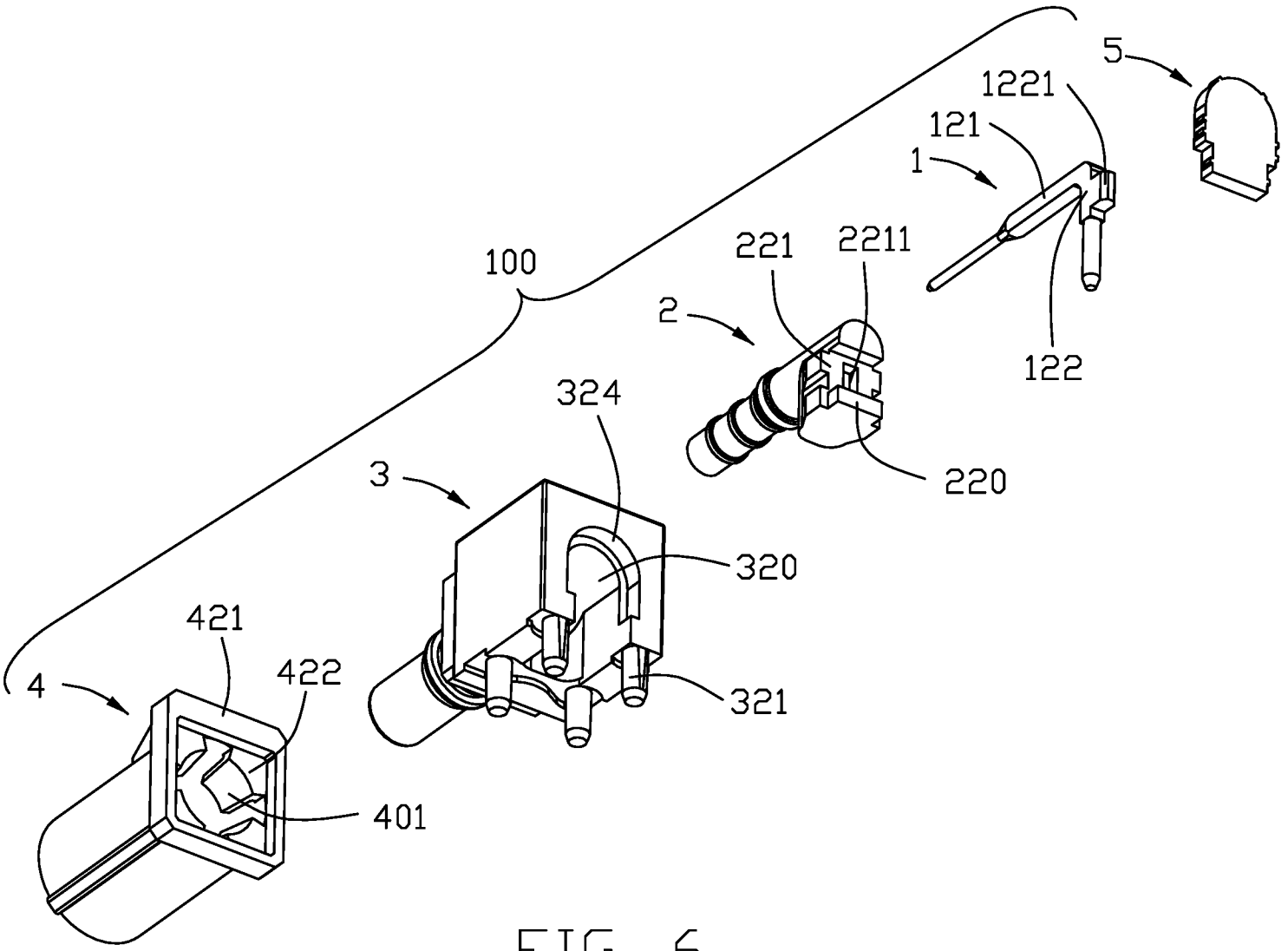
FIG. 6 is a further exploded view of the electrical connector in FIG. 4.
Figure 7:
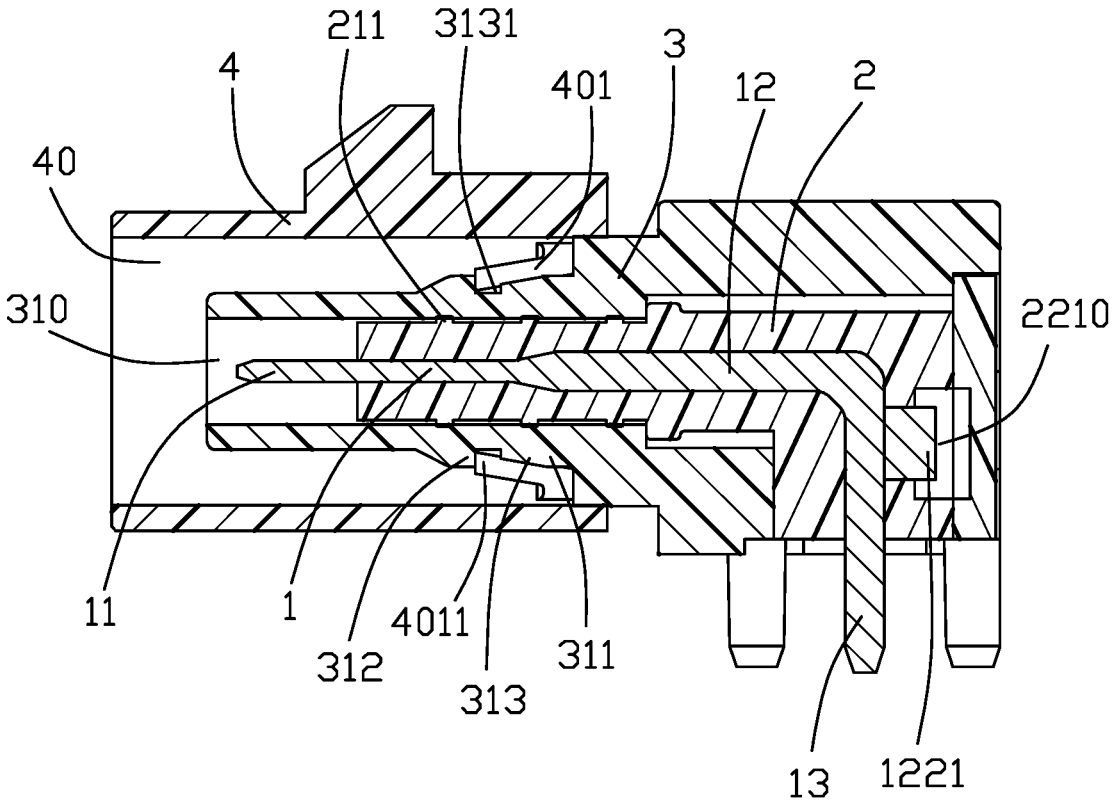
FIG. 7 is a cross-sectional view of the electrical connector taken along line A-A in FIG. 1.

Referring to FIGS. 5-7, the terminal 1 is made of copper alloy and generally L-shaped, including a horizontal first part 121, a mating portion 11 extending forward from the first part, a vertical second part 122 extending downward from the first part, and a tail portion 13 extending downward from the second part. The first part 121 and the second part 122 constitute an intermediate connecting portion 12. The first part 121 and the second part 122 have a rectangular cross-section; the mating portion 11 and the tail portion 13 have a circular cross-section smaller than the rectangular cross-section. Also a diameter of the mating portion 11 is smaller than a diameter of the tail portion 13. During molding the insulator 2, the intermediate connecting portion 12 is connected to a contact carrier strip for facilitating production processes by automatic machines. In the embodiment shown, the carrier strip is connected to the second part 122 through a protrusion 1221.

Referring to FIGS. 5-6, the insulator 2 includes a first portion 21 corresponding to and enclosing the first part 121 of the terminal 1 and a second portion 22 corresponding to and enclosing the second part 122 of the terminal 1. The first portion 21 has annular ribs 211. The second portion 22 has a rear face 220, a recess 221, and a channel 2211 through which the protrusion 1221 is exposed to the recess 221 or air. The mating portion 11 extends forwardly out of the first portion 21.

Figure 3:
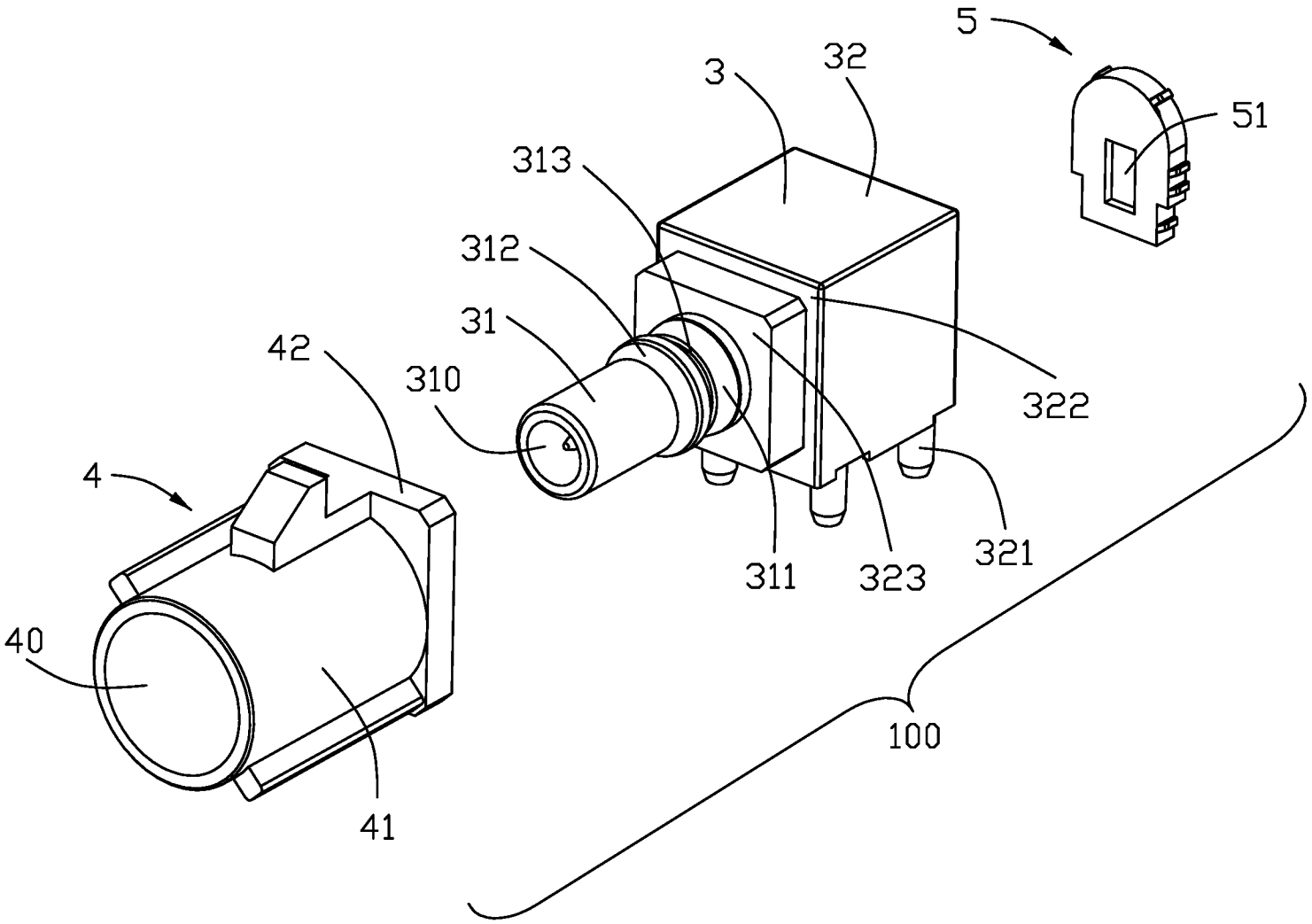
FIG. 3 is an exploded view of the electrical connector.
Figure 4:
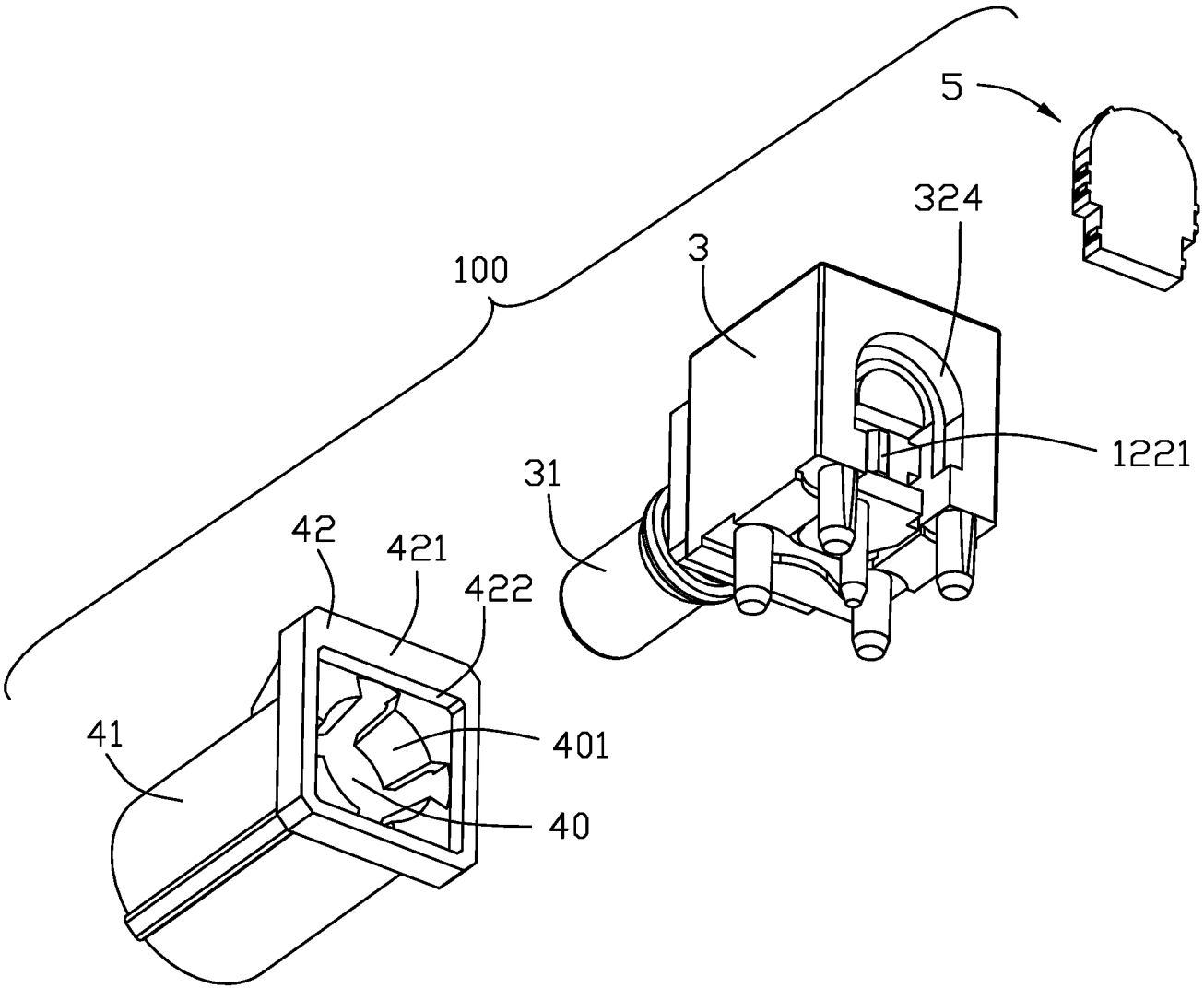
FIG. 4 is another exploded view of the electrical connector.

The outer conductor 3 is made of zinc alloy. Referring to FIGS. 1-6, the outer conductor 3 includes a cylindrical body part 31 receiving the first portion 21 of the insulator 2 and a rectangular base part 32 receiving the second portion 22 of the insulator 2. The body part 31 has a front opening 310. The mating portion 11 extending out of the first portion 21 is positioned within the body part 31. The annular ribs 211 of the insulator 2 are interference fit in the body part 31. The base part 32 has four bottom posts 321, a receiving space 320 for accommodating the second portion 22 of the insulator 2, a front face 322, a rectangular stopper 323 in front of the front face 322, and a rear opening 324 through a bottom thereof. The second portion 22 of the insulator 2 is exposed to the rear opening 324 so that the protrusion 1221 of the terminal 1 is exposed to air. Referring to FIGS. 3 and 7, the outer conductor 3 further includes a first annular portion 311 proximal to the rectangular stopper 323, a second annular portion 312 in front of the first annular portion 311, and a lodging portion 313 between the first and second annular portions. The first annular portion 311 has a larger outside diameter than the second annular portion 312. The lodging portion 313 has a groove 3131 right behind the second annular portion 312.

Referring to FIGS. 4-7, the latching housing 4 is made of plastics to have a front cylindrical part 41 defining a receiving space 40 and a rear rectangular part 42. The rectangular part 42 includes a rear face 421 and a rear opening 422. The latching housing 4 has plural spring arms 401 which are evenly circumferentially arranged about the center for engaging the lodging portion 313. The spring arm 401 has an abutting end 4011 received in the groove 3131 of the lodging portion 313.

Referring to FIGS. 5-7, the rear metallic plate 5 is received in the opening 324 to shield a back side of the electrical connector. The plate 5 has a recess 51 facing the protrusion 1221 of the terminal 1. The recess 51 and the recess 221 of the insulator second portion 22 define a space 2210 so that the protrusion 1221 of the terminal 1 is exposed to air while spacing a desired distance from the metallic plate 5 for impedance matching.

Since the mating portion 11, the intermediate connecting portion 12, and the tail portion 13 have different cross-sections which affect impedance, provision of the protrusion 1221 exposed to air in the space 2210 for coupling to the metallic plate 5 is expected to reduce loss due to abrupt changes of cross-sections of the terminal 1.

The electrical connector 100 is manufactured in a generally known manner in view of its various components, namely the terminal 1, the insulator 2, the outer conductor 3, the rear metallic plate 5, and the latching housing 4. Specifically, after the insulator 2 is insert-molded with the terminal 1, bridge connecting the contact carrier strip to the protrusion 1221 is severed. The insulator 2 and the terminal 1 are mounted from a back side of the outer conductor 3 along a back-to-front direction; the rear metallic plate 5 is mounted to the outer conductor 3 also along this back-to-front direction.

What is claimed is:

1. An electrical connector comprising:

an insulator;

a terminal secured in the insulator and having a front mating portion, a tail portion, and an intermediate portion;

an outer conductor receiving the insulator and including a cylindrical body part and a rectangular base part, a circumferential groove formed around a rear portion of the cylindrical body part;

a rear metallic plate secured to the outer conductor; and an insulative latching housing including a front cylindrical part defining a receiving space to receive the cylindrical body part of the outer conductor therein, and a rear rectangular part to receive a rectangular stopper of the rectangular base part of the outer conductor therein; wherein a plurality of spring arms unitarily forwardly extend from a boundary between the front cylindrical part and the rear rectangular part of the insulative latching housing and are evenly and circumferentially arranged with one another around a center of the front cylindrical part of the insulative latching housing with thereof corresponding abutting ends engaged within the circumferential groove.

2. The electrical connector as claimed in claim 1, wherein the terminal intermediate portion includes a vertical part having a rearward protrusion extending toward the rear metallic plate.

3. The electrical connector as claimed in claim 2, wherein the rearward protrusion is hidden by the rear metallic plate in a front-to-back direction.

4. The electrical connector as claimed in claim 3, wherein the rearward protrusion is spaced from the rear metallic plate with a predetermined distance.

5. The electrical connector as claimed in claim 4, wherein the rearward protrusion extends rearwardly through the insulator.

6. The electrical connector as claimed in claim 5, wherein the insulator forms a recess to receive the rearward protrusion.

7. The electrical connector as claimed in claim 6, wherein the rear metallic plate forms another recess aligned and communicating with the recess of the insulator.

8. The electrical connector as claimed in claim 7, wherein a vertical dimension of the recess of the insulator is essentially similar to that of said another recess of the rear metallic plate.

9. The electrical connector as claimed in claim 8, wherein a vertical dimension of the rearward protrusion is smaller than that of the recess of the rear metallic plate.

10. The electrical connector as claimed in claim 9, wherein a transverse dimension of the rearward protrusion is smaller than that of the recess of the rear metallic plate.

* * * * *